United States Patent [19]

Hardman et al.

[11] 3,934,168

[45] Jan. 20, 1976

[54] GRID SUPPORT MEANS FOR A PLANAR TUBE

[75] Inventors: Wendell G. Hardman; Werner Brunhart, both of Salt Lake City, Utah

[73] Assignee: Varian Associates, Palo Alto, Calif.

[22] Filed: July 18, 1974

[21] Appl. No.: 489,690

[52] U.S. Cl. ..... 313/293; 313/287; 313/296; 313/348

[51] Int. Cl.[2] ..... H01J 1/46; H01J 21/10

[58] Field of Search ..... 313/348, 349, 350, 287, 313/296, 299, 293

[56] References Cited

UNITED STATES PATENTS

| | | | |
|---|---|---|---|
| 2,460,381 | 2/1949 | Forgue | 313/348 X |
| 3,238,410 | 3/1966 | Beggs | 313/348 |
| 3,334,263 | 8/1967 | Beggs | 313/348 |
| 3,500,107 | 3/1970 | Beggs | 313/348 |
| 3,800,378 | 4/1974 | Lee et al. | 313/348 |

*Primary Examiner*—Saxfield Chatmon, Jr.
*Attorney, Agent, or Firm*—Stanley Z. Cole; D. R. Pressman; R. K. Stoddard

[57] ABSTRACT

A grid electrode for an electron tube with planar electrodes consists of a planar array of fine wires mounted on a support frame. The support frame has a circular outside rim and interconnected interior elements dividing the area inside the rim into three or more separated apertures. The interior elements include radial elements connected to non-radial elements, forming a mechanically rigid structure with good heat conduction to the outside rim which resists buckling out of its plane when differentially heated.

9 Claims, 10 Drawing Figures

FIG. 1
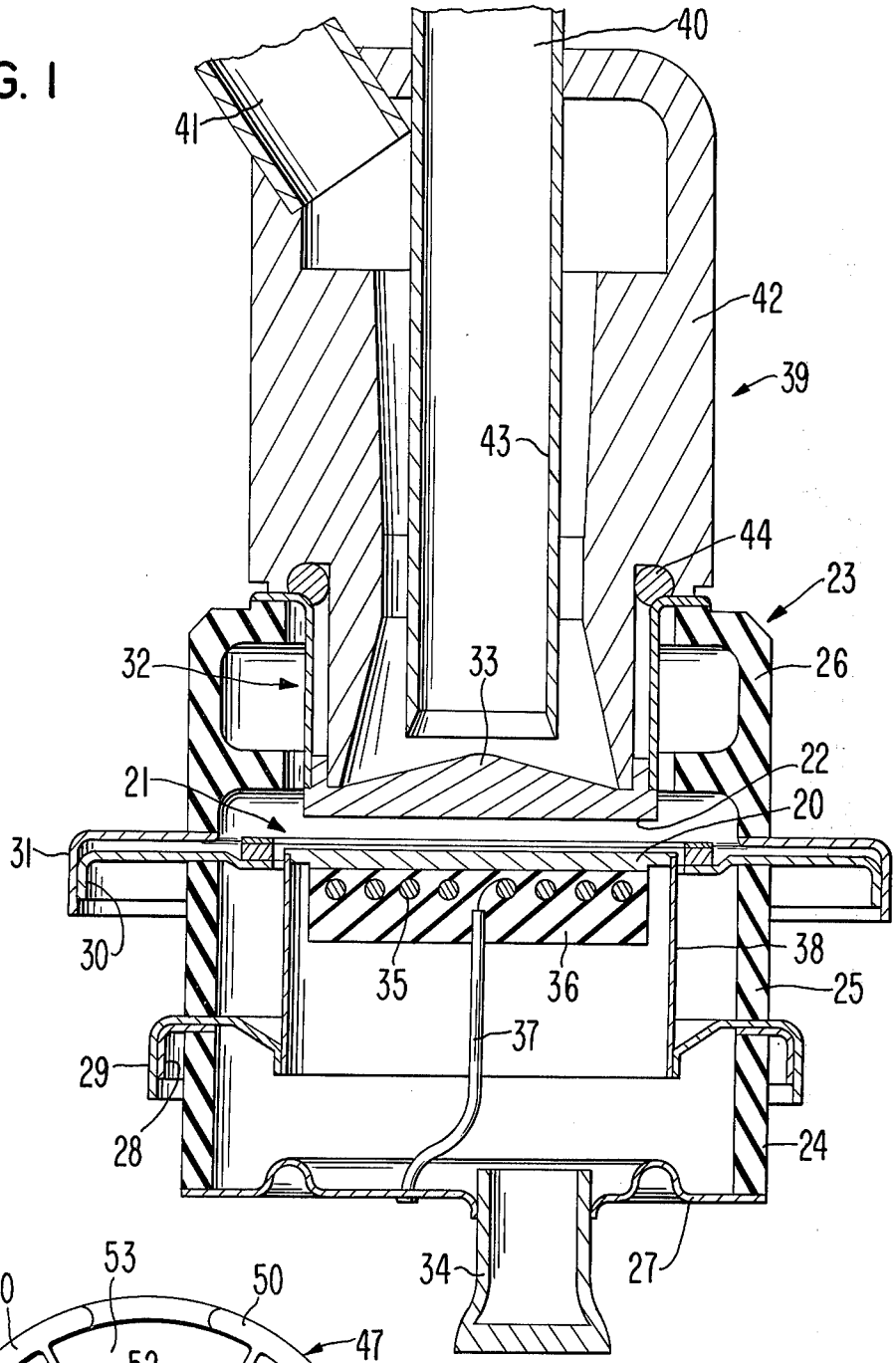
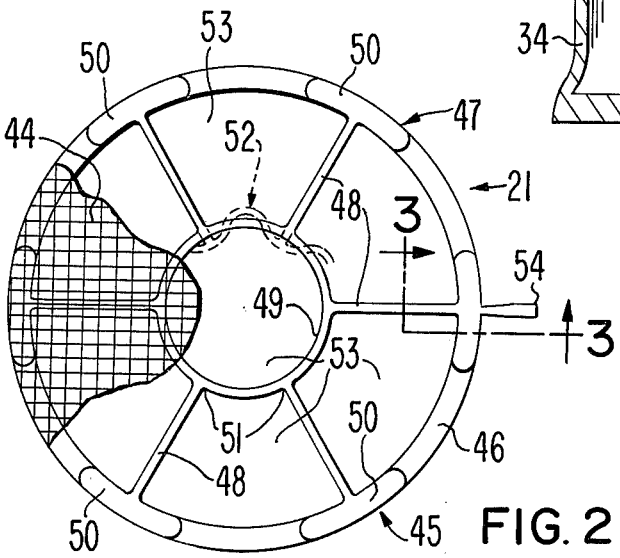
FIG. 2
FIG. 3
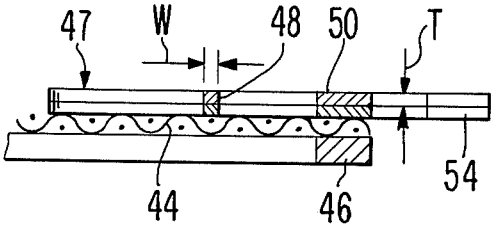

GRID SUPPORT MEANS FOR A PLANAR TUBE

FIELD OF THE INVENTION

The invention relates to electron tubes of the planar grid-controlled type which are widely used to generate high frequency electromagnetic energy. The upper frequency of such tubes is limited by the time of transit of electrons through the electrode structure, which must be short compared to the radio frequency cycle period to allow efficient operation. The transit time is reduced by positioning the electrodes close together, particularly the grid close to the cathode. For the precise mechanical tolerances required, a planar structuring of the electrodes is desirable.

PRIOR ART

Previous planar grids comprise a mesh or parallel array of fine wires joined to a frame. The wires are usually tensioned by mechanical stress or thermal expansion differential at the time they are joined to the frame. The tension helps to hold them accurately in their plane as they become heated by radiation from the thermionic cathode and by electron bombardment. Since the wires are heated more than the support frame they tend to expand, eventually losing their tension and, upon further heating, buckle.

For larger electrode dimensions the grid wires get hotter because the heat conduction path to the frame is longer and the thermal expansion difficulty is more severe. Also, the mechanical stiffness of the wires is reduced and their resonant frequencies go down so that the tube is less resistant to shock and vibration.

Several methods have been devised to support the wires at intervals within the active area of the electrodes by relatively massive members which increase mechanical stiffness and heat conductivity, in an attempt to simulate the performance of smaller grids. U.S. Pat. No. 2,446,271, issued Aug. 3, 1948, to W. W. Eitel, shows bars across the grid joined to and perpendicular to the array of fine wires which control the electron stream. While these bars improve the thermal and mechanical properties, the bars themselves become hotter than the peripheral grid frame and tend to buckle out of their plane.

U.S. Pat. No. 3,082,339, issued Mar. 19, 1963 to R. E. Manfredi, shows a cross-bar slotted in the middle to allow differential expansion without buckling, Unfortunately, the slot reduces the mechanical stiffness.

U.S. Pat. No. 3,297,902, issued Jan. 10, 1967, to J. E. Beggs shows an array of curved grid elements which cooperate with an array of finer elements to control the discharge. In this structure, if the heavier elements are massive enough to provide mechanical rigidity and thermal conductivity, they no longer control the discharge but merely form a dead area whence no electrons reach the anode. Also, the curved elements cannot be tensioned.

SUMMARY OF THE INVENTION

The objective of this invention is to provide a planar grid having improved thermal dissipation and mechanical rigidity which will not buckle out of its plane when differentially heated.

A further objective is to provide a grid frame which is easily fabricated as by photoetching.

A further objective is to provide a grid frame which can be accurately fabricated with a high ratio of member thickness to width.

The invention comprises a circular grid for planar tubes. The structure controlling the electron flow is an array of fine grid wires parallel to the cathode. Either parallel wires or a woven mesh may be used. The array of wires is supported by brazing it to a relatively massive frame, the wires preferably being in tension after the mounting operations. The frame has an outer rim connected with interior support elements which reduce the free length of fine wires between supports. To maximize the thermal conductivity of the interior support elements to the outer rim, as well as the mechanical rigidity, some of the interior support elements are radial, providing the shortest possible path to the outer rim. Interconnecting the radial elements are other, non-radial frame elements. The combination of radial and non-radial elements further shortens the free lengths of fine wires by dividing the grid area into a multiplicity of apertures bounded by frame members. In one preferred embodiment the non-radial elements lie on a circle concentric with the outer rim. The support elements are preferably extended rib portions of a unitary metallic sheet from which intervening openings have been etched away.

In prior-art grids the interior frame elements were either straight bars across the outer rim and subject to buckling when heated, or else free at their inner ends and subject to bending by shock and vibration. The present invention overcomes both of these disadvantages by joining the radial elements with non-radial elements which permit thermal expansion in the plane of the grid and still provide mechanical support and thermal conductivity.

Further features of the invention will become apparent on examination of the figures and following description.

BRIEF DESCRIPTION OF THE FIGURES

FIG. 1 shows in section a planar triode tube employing the invention.

FIG. 2 is a plan of a grid electrode according to the invention.

FIG. 3 is an enlarged section of a portion of the electrode of FIG. 2.

DESCRIPTION OF THE INVENTION

Figure 4:
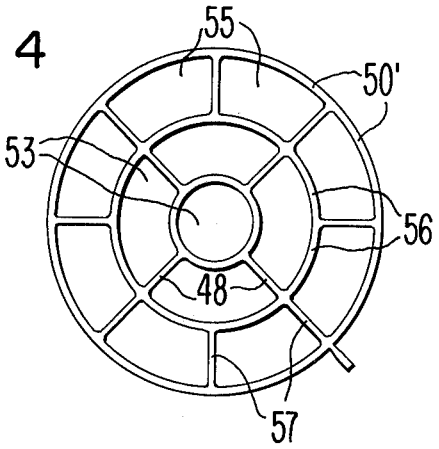
FIG. 4 is a plan of an alternative design of grid frame.

FIG. 1 illustrates a planar triode embodying the invention. The triode electrodes are a thermionic cathode 20, a grid electrode 21 and an anode surface 22. The electrodes 20, 21, 22 are housed in a vacuum-tight envelope 23 comprising dielectric cylinders 24, 25, 26, as of alumina ceramic, sealed at their ends to thin metal flanges 27, 28, 29, 30, 31, 32, as of copper-nickel alloy, an anode heat dissipation body 33, as of copper, and an evacuation pinch-off 34, as of copper. The envelope is assembled by joining, as by welding, flange 28 to 29 and 30 to 31. After evacuation, pinch-off 34 is cold-welded shut by pressure.

Cathode 20, as of porous tungsten impregnated with barium aluminate, is heated by a coil of wire 35, as tungsten, embedded in a dielectric insulator 36, as of alumina. One end of wire 35 is joined, as by spot welding, to cathode 20 and the other is joined through heavy lead-in wire 37 to heater terminal flange 27. Cathode 20 is supported, as by spot welding, on a thin metal heat dam 38, as of iron-nickel-cobalt alloy, which is mounted on envelope flange 29.

Anode body 33 is joined, as by brazing, to envelope flange 32. Heat is removed from anode body 33 by a circulating fluid, as water, contained and directed by a water jacket 39 comprising inlet and outlet pipes 40, 41, an external housing 42, and internal flow-directing pipe 43 and an O-ring seal 44, as of rubber, for containing the fluid. The metallic parts of the water jacket, 40, 41, 42, 43 may be of any noncorrodible metal, as Monel, stainless steel, brass, etc.

Grid electrode 21 is mounted, as by brazing or spot welding, on envelope flange 30.

FIGS. 2, 3 and 4 illustrate the detailed structure of grid electrode 21. A mesh of fine wires 44, as of tungsten, is brazed, as with gold, to an apertured frame 45 consisting of a relatively heavy outer rim support element 46 and a flat web 47 of support elements with cross section large compared to the wires of mesh 44. Both parts 46, 47 of frame 45 are preferably made of the same metal, as tungsten, and are brazed, as with gold, together and to the intervening mesh 44. Web 47 comprises radial support elements 48 interconnected with non-radial support elements 49. In this preferred embodiment the non-radial elements 49 lie on concentric circles and the radial elements lie on radii of these circles.

The radial elements 48 form the shortest possible path for conducting heat from the center of grid 21 to the outer rim 46 from which it is easily conducted by flange 30 to the cooled envelope 23. Being thus short also increases their mechanical rigidity and the ability of the tube to operate properly while subjected to shock and vibration. In this preferred embodiment, radial elements 48 terminate at the outer ring 46 in arcuate tabs 50 forming increased areas for brazing to grid mesh 44 and outer ring 46. At their inner ends radial elements 48 terminate at their junctions 51 with non-radial elements 49. During the brazing assembly of the grid frame the interior elements of web 47 are heated to a higher temperature than the outer ring 46, thereby expanding radially relative to ring 46. Tabs 50 are separated from each other rather than joined into a complete circle, so they slide radially outward over ring 46 without the buckling that would occur if they were restrained by a complete colder ring. Parts 46, 47 and 44 are then brazed together. On cooling the interior elements of web 47 tend to contract more than outer ring 46 but are restrained by the more massive ring 46. The interior elements are thus left in tension, which restrains them to stay accurately planar.

In operation of the tube the central part of the grid is heated more than the outer ring 46. The tendency of the interior elements to expand is cancelled by their residual tension, so the differential heating merely results in a decrease of tension. If the heating becomes excessive so that the tension is completely relieved, further heating will cause the radial members 48 to expand inwardly with respect to outer ring 46, forcing junctions 51 inward. However, non-radial elements 49 are deformable in the plane of the grid 21, as shown, greatly exaggerated, by the dashed line "hot shape" 52. If radial elements 48 were joined to form complete diametral bars as in many prior-art grids, their expansion would force them to buckle, at least partly out of the grid plane.

The connection of radial and non-radial support elements divides the grid area into smaller apertures 53 so the heat conduction path along the mesh wires to the support elements is reduced and the mechanical resonances of the mesh within an individual aperture are inhibited.

FIG. 3 is an expanded section of a portion of FIG. 2. Fabrication of the web structure 47 is most easily done by photoetching a sheet of metal. Rib support elements 48, 49 can by photoetching be made with a width W no less than about equal to the thickness of the sheet T. It is desirable to keep the width W small to minimize current interception by the support structure, but for good rigidity and heat conduction it is better to have the support elements thick in the direction perpendicular to the plane of the grid. This may be accomplished by making two or more identical webs 47, stacking them in alignment as shown and brazing them together. Tabs 54 are used to jig the web structures in azimuthal alignment. After brazing, tabs 54 are broken off and discarded.

FIG. 4 shows only the outline of an alternative grid frame suitable for large area grids. A second set of apertures 55 is formed surrounding set 53 by intermediate non-radial elements 56 connected to outer rim elements 50' by additional radial elements 57.

Figure 5:
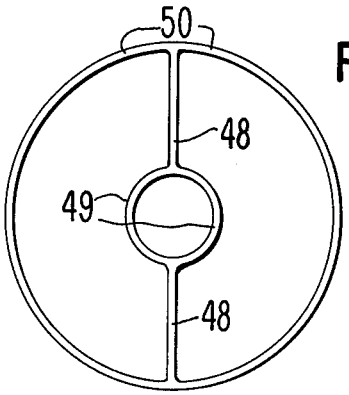
FIG. 5 is a plan of another grid frame.
Figure 6A:
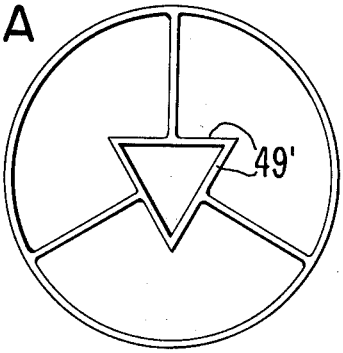
FIG. 6A to 6D show several grid frames in which the nonradial elements are straight bars.
Figure 6B:
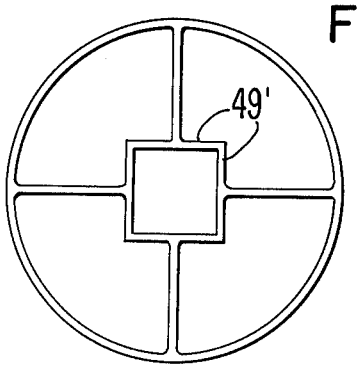
Figure 6C:
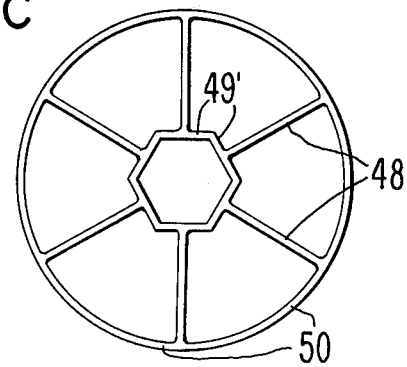
Figure 6D:
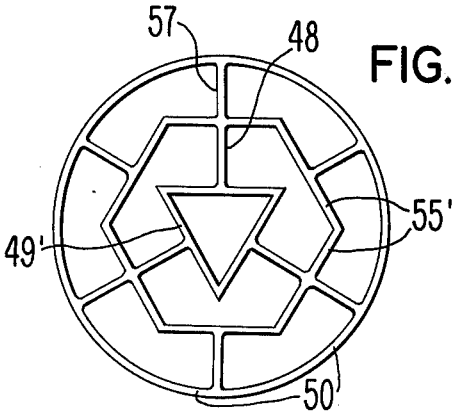

FIG. 5 illustrates a simple form of the invention suitable for small grids where only two radial elements 48 and two non-radial elements 49 are connected within outer rim elements 50.

FIG. 6 shows embodiments of the invention wherein the non-radial elements 49' are formed of straight sections instead of curved. The straight sections are easier to deform in the plane of the grid to accommodate thermal expansion of the radial elements 48. FIGS. 6, *a*, *b*, *c*, *d* show respectively 3, 4 and 6 outer radial elements. FIG. 6 d shows 6 outer radial elements and an inner set of 3 radial elements.

Figure 7:
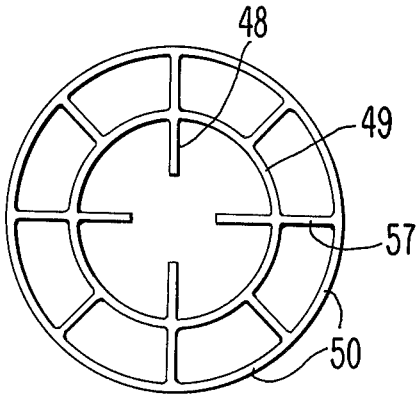
FIG. 7 is a plan of a frame in which the radial elements extend inside the non-radial elements.

FIG. 7 shows an embodiment in which radial elements 48 extend within the innermost non-radial elements 49. The shortness of free length permits them to maintain mechanical rigidity.

Those skilled in the art may realize many embodiments of the invention other than those examples described above. The true scope of the invention includes the content of the following claims and their legal extensions.

What is claimed is:

1. An electron tube comprising; an envelope, a plurality of substantially planar and parallel electrodes, support means for said electrodes, and means for electrical connection to said electrodes, said electrodes comprising an electron emissive cathode, an electron collective anode, and at least one electron permeable grid between said cathode and said anode, said grid comprising a circular frame and an array of spaced wires, said frame comprising an outer rim interconnected with a web of support elements, said support elements having cross sections larger than said wires, said web having planar faces parallel to said cathode, said support elements comprising a plurality of radial elements connected to said rim and interconnected by non-radial elements lying entirely within said rim to form at least three enclosed apertures within said rim, said array of wires being joined to the face of said web facing said cathode, and covering said apertures.

2. The apparatus of claim 1 wherein one of said apertures is a central aperture substantially surrounded by other of said apertures.

3. The apparatus of claim 1 wherein said non-radial elements lie on one or more circles concentric with said circular frame.

4. The apparatus of claim 1 wherein at least one of said radial elements extends over less than a full radius of said circular frame.

5. The apparatus of claim 1 wherein said radial elements are spaced from the center of said circular frame.

6. The apparatus of claim 1 wherein said web is a structure comprising a plurality of identical joined layers parallel to said planar array.

7. The apparatus of claim 1 wherein said radial elements are under tension when said grid is isothermal.

8. The apparatus of claim 1 wherein said outer rim comprises a massive circular ring, and said plurality of radial elements connected to said rim are separately joined to said ring.

9. The apparatus of claim 1 wherein said radial elements are interconnected within said rim only by said non-radial elements and said array of wires.

* * * * *